US007479023B2

(12) United States Patent
Czarnyszka

(10) Patent No.: US 7,479,023 B2
(45) Date of Patent: Jan. 20, 2009

(54) CONNECTOR FOR A CONTACT ELEMENT

(75) Inventor: Emmanuel Czarnyszka, Champagne (FR)

(73) Assignee: Souriau, Versailles (FR)

( * ) Notice: Subject to any disclaimer, the term of this patent is extended or adjusted under 35 U.S.C. 154(b) by 66 days.

(21) Appl. No.: 11/546,876

(22) Filed: Oct. 12, 2006

(65) Prior Publication Data

US 2007/0093109 A1 Apr. 26, 2007

(30) Foreign Application Priority Data

Oct. 20, 2005 (FR) ..... 05 53187

(51) Int. Cl.
*H01R 13/62* (2006.01)

(52) U.S. Cl. ..... 439/307

(58) Field of Classification Search ..... 439/307, 439/318

See application file for complete search history.

(56) References Cited

U.S. PATENT DOCUMENTS

| | | | | |
|---|---|---|---|---|
| 2,784,385 A | | 3/1957 | Ennis | |
| 4,152,039 A | | 5/1979 | Shah | |
| 4,165,910 A | * | 8/1979 | Anderson | 439/318 |
| 4,359,254 A | | 11/1982 | Gallusser et al. | |
| 4,464,001 A | * | 8/1984 | Collins | 439/318 |
| 4,542,952 A | * | 9/1985 | Tomsa | 439/318 |
| 4,639,064 A | * | 1/1987 | Knapp et al. | 439/318 |
| 4,641,811 A | | 2/1987 | Gallusser et al. | |
| 5,181,860 A | * | 1/1993 | Honma et al. | 439/321 |
| 6,039,594 A | * | 3/2000 | Zuppa | 439/318 |
| 6,398,586 B1 | | 6/2002 | Muzslay | |
| 6,811,423 B2 | * | 11/2004 | Yoshigi et al. | 439/315 |
| 2002/0058437 A1 | | 5/2002 | Young et al. | |

FOREIGN PATENT DOCUMENTS

| | | |
|---|---|---|
| EP | 0 124 389 A1 | 11/1984 |
| GB | 2 063 587 A | 6/1981 |

* cited by examiner

*Primary Examiner*—Gary F. Paumen
(74) *Attorney, Agent, or Firm*—Patterson, Thuente, Skaar & Christensen, P.A.

(57) ABSTRACT

A connector for a contact element that is able to be screwed at the front part to a rear part of a first contact element, characterized in that the connector comprises means for locking the connection between the connector and the first contact element, that is able to be engaged during screwing. The locking means comprise, for example, at least one toothed notch that can be engaged in the teeth arranged on the rear extremity of the first contact element. The toothed notch may be elastic in the direction of screwing, in such a way as to allow engagement during screwing.

12 Claims, 1 Drawing Sheet

CONNECTOR FOR A CONTACT ELEMENT

RELATED APPLICATION

The present application claims priority to French Application No. 05 53187 filed Oct. 20, 2005, which is incorporated herein in its entirety by reference.

TECHNICAL FIELD

The invention relates to a connector for a contact element, such as an electrical connector element. More precisely, the invention relates to a device allowing the connection between the connector and the contact element on which it is added to be locked. "Locked" is understood to mean that the connection between the connector and the contact element, once obtained, is maintained, even under extreme conditions, such as strong vibrations.

BACKGROUND OF THE INVENTION

In the prior art, associating a connector with a plug or collar for an electrical connector in order to guide an electrical cable designed to be connected to the plug or collar is known. The connector also allows the connection between said electrical cable and the associated plug or collar to be protected. Such a connector from the prior art is equipped with an inner threading so that it can be screwed on a plug or collar having a corresponding outer threading. More precisely, the connector is formed of a tube that may be cylindrical and of a ring, free in rotation, connected to said cylindrical tube. The ring is equipped with an inner threading and possibly with a locking device. Most often, the locking device is a ratchet device arranged on an inner contour of the ring and an outer counter of the associated plug or collar, and comprises teeth, flexible strips or ball devices. The locking device is equipped with different pitches in the direction of screwing and unscrewing. The locking device has an action principle that may be perpendicular to the axis of the connector, or coincident with the axis. The screwing and unscrewing of the ring on the desired plug or collar therefore ensures the connection between the connector and the plug or collar.

The disadvantage of such a connection between the connector and an electrical contact element, such as a plug or collar, is that several independent elements are necessary to ensure all of the screwing and locking functions; each of these elements must be exactly associated with the other elements so that they may cooperate correctly.

Manufacturing such a connector from the prior art requires great precision. In fact, the dimensions of the cylindrical tube, the ring and the associated plug or collar must be exactly coincident to allow connections between these three elements. Furthermore, as the connector is in two independent parts, the number of handlings necessary for mounting, as well as the risks for errors, are multiplied.

SUMMARY OF THE INVENTION

In the invention, one seeks to resolve the problems stated above by proposing a connection piece that, once it is physically connected to the contact element to which it must be associated, can no longer be untimely separated. Another object of the invention is to provide such a connection piece that has a simple design.

To do this, the connection piece according to the invention comprises a cylindrical tube, whose front section is equipped with a threading that is able to cooperate with a threading of a contact element to which one wishes to associate the front section. The contact element is, for example, an electrical contact, such as a plug or collar, at the extremity of which a cable must be connected. The front section of the connection piece is also equipped with a device for blocking unscrewing. The device for blocking unscrewing is able to prevent unscrewing of the connection piece with relation to the contact element on which it is screwed. The blocking device according to the invention is equipped with at least one flexible step arranged in the thickness of the front cylindrical section of the connection piece. Thickness is understood to refer to the dimension of the wall, perpendicular to the longitudinal axis of the connection piece. The step has a certain flexibility at least in the direction of screwing, in such a way that the step may be engaged in the teeth of the contact element. For example, plugs or collars for electrical connectors are generally equipped with a toothed crown at the level of the rear extremity cooperating with the connection piece. Therefore in the invention, these teeth, which are usually used as indexing means, are utilized to block unscrewing.

Preferentially, during screwing of the connection piece on the contact element, the presence of the blocking device necessitates that a larger stress is applied at the end of screwing than at the start of screwing. In fact, at the end of screwing, the teeth of the contact element come into contact with the step or steps of the connection piece. Of course, it is also possible that the teeth of the contact element are in contact with the step or steps of the connection piece from the start of screwing. The closer the teeth get to the step or steps, the more the teeth compel the step or steps to bend to allow screwing to continue. The locking couple of the connection piece is therefore higher at the end of screwing than at the start of screwing. Vice versa, a larger stress must be exerted at the start of unscrewing than at the end of unscrewing. When the unscrewing blocking device is engaged, the connection piece may be involuntarily unscrewed with difficulty.

In a particular example of embodiment of the invention, the step or steps have a certain flexibility only in one direction of screwing. The more the teeth compel the step or steps to bend at the time of screwing, the more the resistance to unscrewing of the blocking device tends to increase in parallel. In fact, the unidirectional flexibility of the step or steps allows screwing, by allowing the lowering and recovery of the step or steps at each pass of teeth. Conversely, the step or steps are rigid in the direction of unscrewing and resist stresses directed in the direction of unscrewing, to which the teeth tend to compel the steps during an attempt at unscrewing. The step or steps may not bend to allow passage of the teeth in this direction.

If the connector is equipped with an inner threading, to cooperate with an outer threading of the rear part of a contact element, the blocking steps arranged on the connector are directed roughly towards the inside of said connector, in such a way as to be engaged in the teeth of the rear part of the contact element, housed inside the connector. Conversely, if the connector is equipped with an outer threading to cooperate with an inner threading arranged on the rear part of the contact element, the blocking steps of the connector are directed roughly towards the outside of said connector, in such a way as to be engaged in the teeth arranged on the rear part of the contact element and situated at the outer periphery of the connector.

The connection piece according to the invention is advantageously a one-piece piece, and may be obtained directly by molding. It is also possible to machine steps in the thickness of the wall of the connector.

Therefore, the object of the invention is a connector for a contact element, that is able to be screwed at the front part to a rear part of a first contact element, said connector comprising means for locking the screwing between the connector and the first contact element, able to be engaged during screwing, characterized in that the locking means comprise at least one toothed notch arranged on the body of the connector, the toothed notch extending longitudinally on said body and being able to be engaged in the teeth arranged on the rear extremity of the first contact element, said teeth extending longitudinally in the prolongation of said rear extremity.

Contact element is understood to refer equally to an electrical connector, such as a plug or collar, or to a secondary contact element, such as a secondary connector.

In the case where the locking means comprise several toothed notches, said toothed notches are selectively arranged on the body of the connector. Selectively is understood to mean that the toothed notches do not form a continuous crown, but are spaced from each other.

The toothed notch of the connector, like the teeth of the rear extremity of the contact element, respectively extend parallel to the longitudinal axis of said connector and said rear extremity. For example, the toothed notch extends longitudinally in the thickness of the wall of the connector. The teeth of the rear extremity of the contact element extend in the prolongation of the wall of said contact element and form the peripheral part of the rear extremity. The heads of the teeth are oriented parallel to the longitudinal axis of said contact element.

According to the examples of embodiment of the connector according to the invention, it is possible to provide part or all of the following additional characteristics:

- the toothed notch is arranged in the thickness of the wall of the body of the connector;
- the toothed notch is elastic in the direction of screwing, in such a way as to allow engagement during screwing;
- the toothed notch is resistant in the direction of the unscrewing;
- the screwing of the connector on the rear part of the first contact element is irreversible;
- the toothed notch is connected to the body of the connector by a connecting bar that is able to bend during screwing;
- the connector comprises at least two toothed notches distributed symmetrically on the body of the connector;
- the connector comprises a threading in the rear part to be screwed to a second contact element;
- the connector is one piece;
- the connector is in a composite material.

The invention also relates to a connector assembly comprising at least one contact element equipped with a connector according to the invention.

BRIEF DESCRIPTION OF THE DRAWINGS

The invention will be better understood upon reading the following description and examining the accompanying figures. The figures are presented for indication purposes only and in no way limit the invention. The figures show.

DETAILED DESCRIPTION OF THE DRAWINGS

Figure 1:
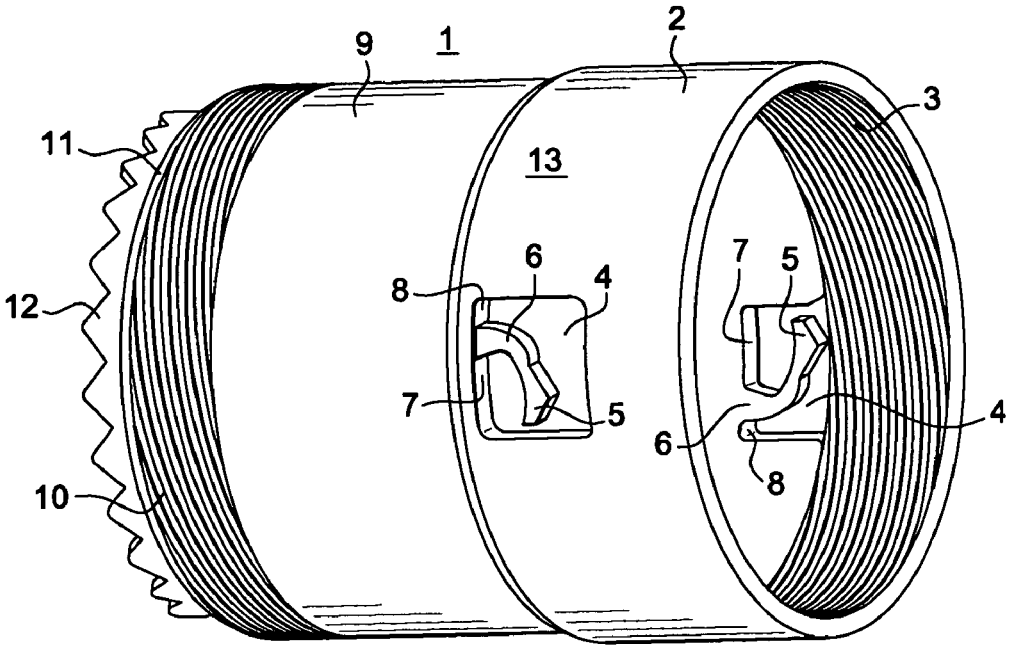
FIG. 1 is a schematic representation of a connector for a contact element according to the invention.

FIG. 1 represents a connector 1 in the form of a tube. A front part 2 (at right in the figure) is equipped with an inner threading 3 designed to cooperate with an outer threading arranged on a contact element to which the connector 1 must be connected. The front part 2 of the connector 1 also comprises two through windows 4, or cutouts, arranged in the thickness of the wall of body 13 of connector 1. The two windows 4 are diametrically opposed from each other and face each other. Each window 4 is equipped with a toothed notch 5. The toothed notches 5 are therefore accessible from the outside of the connector 1.

Each toothed notch 5 is connected to a flange 7 of the corresponding window 4, by a flexible foot 6. The toothed notch 5 and the flexible foot 6 form the locking means for screwing according to the invention. The flexible foot 6 is connected, by a free extremity opposite the extremity carrying the toothed notch 5, to a corner 8 of the flange 7 of window 4, in such a way that the toothed notch 5 is oriented in the direction of screwing. Therefore, the foot 6 and the toothed notch 5 extend in the prolongation of the wall from the corner 8 of the window 4. The foot 6 is preferentially pliable, that is, flexible, only in the direction of screwing. Therefore, the foot 6 and the toothed notch 5 to which the foot is connected are able to bend when stresses to which they are subjected are directed in the direction of screwing. On the other hand, when stresses are imposed in the direction of unscrewing, the foot 6 remains rigid, prohibiting any movement of the toothed notch 5.

Figure 2:
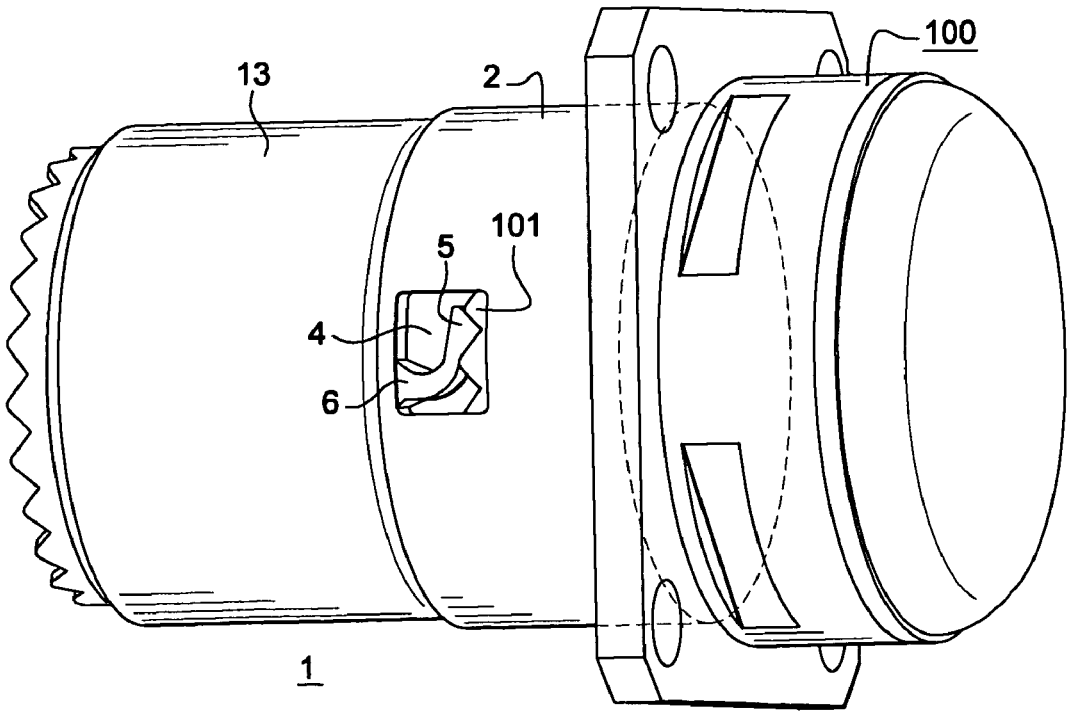
FIG. 2 is a schematic representation of the connection between a connector according to the invention and a collar.

As is represented in FIG. 2, the toothed notches 5 (a single toothed notch is visible in FIG. 2) are able to cooperate with the teeth 101 situated on the rear part of a collar 100 in such a way as to lock the connection between the connector 1 and the collar 100. More precisely, the rear part of the collar 100 is housed in the front part 2 of the connector 1, in such a way that the teeth 101 are also situated inside the connector 1 and come into contact with the toothed notches 5 of the connector 1. The toothed crown 101 forms the outer contour of the rear part of the collar 100. The teeth 101 extend in the prolongation of the wall of the collar 100 in such a way that the heads of the teeth 101 are directed parallel to the longitudinal axis of the collar 100.

The collar 100 is equipped with an outer threading (not visible in FIG. 2) that is able to cooperate with the inner threading 3 of the connector 1 such that the connector 1 can be screwed onto collar 100.

The toothed crown 101 arranged on the periphery of the rear part of the collar 100 is situated inside the connector 1 when the collar 100 is screwed onto connector 1. The windows 4 are arranged on body 13 of the connector I and with relation to the inner threading 3 in such a way that the toothed notches 5 come to be engaged in the teeth 101 of the collar 100 at the end of screwing of the collar 100 onto connector 1. To do this, the windows 4 are arranged at a sufficient distance from the inner threading 3 so that the toothed notches 5 overlap the end of the inner threading 3. End of inner threading 3 is understood to refer to the part that is farthest from the flange of the front part 2 of the connector 1. Overlap is understood to mean that the toothed notches 5 extend across the inner threading 3, that the notches therefore selectively interrupt the threading in its circular continuity. The earlier the toothed notches 5 overlap on the inner threading 3, the earlier in the course of screwing it is necessary to exert extra stress to continue the screwing. The flexibility of the foot 6 in the direction of curvature allows the teeth 101 to be able to force the toothed notch 5 to bend to allow teeth 101 to pass.

End of screwing is understood to refer to a ratcheting sound corresponding to the engagement of the teeth 101 on the toothed notches 5. The operator in charge of assembling the connector 1 and the collar 100 is therefore informed that this occurs at the end of screwing.

The locking means 5, 6 according to the invention make screwing of the connector 1 onto the collar 100 irreversible. Irreversible is understood to mean that the collar 100 may not be untimely unscrewed, even partially, with relation to the connector 1. When the collar 100 is forced in the direction of unscrewing, the teeth 101 of the collar 100 are blocked in position by the toothed notches 5. In fact, the toothed notches 5 may not bend to allow the teeth 101 to pass, since the feet 6 remain rigid. If one wishes to unscrew the collar 100 from the connector 1, it is necessary that an operator makes the toothed notches 5 bend, for example manually, by pressing on said toothed notches 5 in the direction of curvature of the foot 6, corresponding to the direction of screwing. This is made possible by the fact that the toothed notches 5 are accessible from the outside of the body 13 of the connector 1. The toothed notches 5 must be sufficiently bent so that the teeth 101 are completely disengaged from said toothed notches 5. Unscrewing may therefore take place. Of course, the irreversibility of the locking may be extended in a more definitive manner, that is, the collar 100 becomes inseparable from the connector I once they are screwed to each other.

In the example represented in FIG. 1, the locking means comprise two toothed notches 5 arranged opposite each other on the body 13 of the connector 1, that is, symmetrically with relation to the longitudinal axis of the connector 1. Of course, it is also possible to provide a single window 4 and therefore a single toothed notch 5. It is also possible to provide a higher number of windows 4, all disposed at the same distance from the inner threading 3, and therefore more or less overlapping on said inner threading 3, and each equipped with a toothed notch 5. Preferentially, the windows 4 are arranged so as to be regularly spaced on the rear part 2 of the connector 1 so that the locking of the screwing of the connector 1 on the collar 100 is balanced. Regularly spaced is understood to mean, for example, that the windows are equidistant little by little.

It is also possible to provide several windows 4 arranged at different distances from the inner threading 3. Therefore, several degrees of locking of screwing exist. The more it is screwed, the higher the number of toothed notches 5 are engaged in teeth 101 of collar 100. For example, a first series of toothed notches 5 is engaged in the middle of screwing, at which is added a second series of toothed notches 5 engaged at the end of screwing, the toothed notches 5 of each of the series being disposed staggered or some under others.

The connector 1 such as represented in FIG. 1 is also equipped at its rear part 9 (at left in the figure) with an outer threading 10. An outer threading 11 of the rear part 9 is equipped with a toothed crown 12 oriented in such a way that the heads of teeth 12 are directed to the outside of the connector 1, parallel to the longitudinal axis of said connector 1. The outer threading 10 allows, for example, the connector 1 to be connected to a second contact element. The second contact element is for example a second connector, able to be connected to a plug or a collar belonging to a family of connectors different from the family of connectors to which the collar 100 belongs, to which connector 1 is connected by its front part 2.

The toothed crown 12 situated on the rear part 9 of the connector 1 may for example be used as indexing means to position correctly the connector 2 with relation to the second contact element. It is also possible to use the teeth 12 to lock the screwing of connector 1 on the second contact element, itself equipped with locking means 5, 6 such as described previously. Of course, the connector 1 according to the invention may be equipped with an inner threading, or may be lacking any threading and/or toothed crown 12 in the rear part 9.

The connector 1 according to the invention may be used as a ground connection for guiding the cable before being connected to the plug or collar 100 to which the connector is screwed, but also as an adapter to connect a contact element belonging to a first family of connectors to a second family of connectors.

The invention claimed is:

1. A connector for a contact element, the connector being adapted to be screwed at a front part of the connector to a rear part of a first contact element, said connector being a one-piece connector comprising:

a cylindrical tube; and a locking mechanism adapted to be engaged by screwing the rear part of the first contact element into the front part of the connector, wherein the locking mechanism comprises structure defining at least one aperture, each aperture being formed in a wall of the cylindrical tube, and a locking tooth extending longitudinally on said cylindrical tube and at least partially within a corresponding aperture, the locking tooth being formed from a of the wall of the cylindrical tube, wherein the locking tooth is adapted to engage teeth positioned on a rear extremity of the first contact element, said teeth extending longitudinally in prolongation of said rear extremity.

2. The connector according to claim 1, wherein the locking tooth is elastic in a direction of screwing in such a way as to allow engagement during screwing.

3. The connector according to claim 1, wherein the locking tooth is resistant in a direction of unscrewing.

4. The connector according to claim 1, wherein engagement of the locking tooth with the teeth positioned on the rear extremity of the first contact element inhibits unscrewing of the first contact element from the connector.

5. The connector according to claim 1, wherein the locking tooth is operably connected to a perimeter of the corresponding aperture of the cylindrical tube by a connecting bar adapted to bend during screwing, thereby allowing the locking tooth to pass over at least one of the teeth positioned on the rear extremity of the first contact element.

6. The connector according to claim 1, wherein the connector comprises a composite material.

7. The connector according to claim 1, wherein the connector comprises at least two locking teeth distributed symmetrically on the cylindrical tube of the connector.

8. The connector according to claim 1, wherein the connector comprises a threading in a rear part of the connector such that the connector is adapted to be screwed to a second contact element.

9. A connector assembly comprising at least one contact element equipped with a connector according to claim 1.

10. The connector according to claim 3, wherein the locking tooth is accessible from an outside surface of the cylindrical tube to allow disengagement of the locking tooth from the teeth positioned on the rear extremity of the first contact element, thereby allowing unscrewing of the first contact element from the connector.

11. The connector according to claim 5, wherein the connecting bar is adapted to remain rigid when stresses are introduced in a direction of unscrewing upon engagement of the locking tooth and the teeth positioned on the rear extremity of the first contact element, thereby inhibiting unscrewing of the first contact element from the connector.

12. The connector according to claim 8, wherein the rear portion of the connector further comprises teeth extending longitudinally from the rear portion, the teeth being adapted to engage with at least one locking tooth positioned on the second contact element.

* * * * *

UNITED STATES PATENT AND TRADEMARK OFFICE

CERTIFICATE OF CORRECTION

PATENT NO. : 7,479,023 B2
APPLICATION NO. : 11/546876
DATED : January 20, 2009
INVENTOR(S) : Czarnyszka It is certified that error appears in the above-identified patent and that said Letters Patent is hereby corrected as shown below:

Column 4, Line 37:
Delete "I" and insert --1--.

Column 5, Line 10:
Delete "I" and insert --1--.

Column 6, Line 14:
After "from a" insert --thickness--.

Signed and Sealed this

Twentieth Day of July, 2010

David J. Kappos

David J. Kappos
*Director of the United States Patent and Trademark Office*